US006367721B1

(12) United States Patent
Ikeya et al.

(10) Patent No.: US 6,367,721 B1
(45) Date of Patent: Apr. 9, 2002

(54) FUEL INJECTION VALVE

(75) Inventors: Masaki Ikeya; Sumito Takeda, both of Obu (JP)

(73) Assignee: Aisan Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/614,908

(22) Filed: Jul. 12, 2000

(30) Foreign Application Priority Data

Oct. 26, 1999 (JP) ..... 11-304024

(51) Int. Cl.[7] ..... B05B 1/30; F02M 51/00; F02M 61/08

(52) U.S. Cl. ..... 239/585.4; 239/585.1; 239/585.2; 239/585.3; 239/585.5; 239/533.7

(58) Field of Search ..... 239/585.1, 585.2, 239/585.3, 585.4, 585.5, 533.2, 533.7, 533.9; 251/50

(56) References Cited

U.S. PATENT DOCUMENTS 4,317,542 A * 3/1982 Morishita et al. ..... 239/585.5
4,637,554 A * 1/1987 Takeda ..... 239/585.4
5,141,164 A * 8/1992 Ohno et al. ..... 239/585.2
5,242,118 A * 9/1993 Schmidt et al. ..... 239/533.4

FOREIGN PATENT DOCUMENTS

JP 360204956 A * 10/1985 ..... 123/490

* cited by examiner

*Primary Examiner*—Henry C. Yuen
*Assistant Examiner*—Davis Hwu
(74) *Attorney, Agent, or Firm*—Arent Fox Kintner Plotkin & Kahn, PLLC

(57) ABSTRACT

The fuel injection valve of the present invention is constituted such that a needle valve 5 and a movable core 4 are movably disposed in an axial direction in the inside of a body 1. Here, a fixed member 8 which the movable core 4 approaches at the time of closing the valve is disposed in the body 1, and a gap is formed between the movable core 4 and the fixed member 8 at the time of closing the valve. When fuel remaining in the gap between the movable core 4 and the fixed member 8 is pressurized according to the movement of the movable core 4 to the valve closing side, a squeezing portion $SB_1$ is disposed at a portion which constitutes a passage for the fuel extruded from the gap. At the time of closing the valve, a squeezing reaction force (reaction force against the squeezing-out force or pushing-out force generated at the time of pressurizing a liquid and squeezing a liquid through the gap) is generated on the movable core 4. Since the squeezing reaction force is increased in an inversely proportional manner to the cube of the size of the gap between the movable core 4 and the fixed member 8, even when the gap between two opposing surface (that is, the gap between the proximal end surface of the fixed member 8 and the distal end surface of the movable core 4) is small, a large squeezing reaction force is generated. Further, a braking is quickly applied to the movable core 4 and and the needle valve 5 due to this squeezing reaction force just slightly before the point of time when the valve is closed.

9 Claims, 10 Drawing Sheets

(a)

(b)

(c)

FUEL INJECTION VALVE

BACKGROUND OF THE INVENTION

1. Field of the Invention

The present invention relates to an electromagnetic-type fuel injection valve used in an internal combustion engine, and more particularly to a fuel injection valve which can reduce operating sound and can enhance the fuel metering performance by making use of a squeezing reaction force of a liquid (residual fuel) occurring in the periphery of a movable core at the time of closing the valve.

2. Description of the Prior Art

An electromagnetic-type fuel injection valve used in an internal combustion engine is generally constituted such that a fuel connection tube is fixedly secured to an upper portion of a body, an electromagnetic solenoid is disposed in the inside of the body, a movable core which is slidably movable by an excitation of the electromagnetic solenoid is provided, a needle valve is mounted on a distal end side of the movable core, a nozzle body which is provided with a valve seat is mounted on a distal end side of the body in such a manner that the nozzle body surrounds the needle valve. And further, an insert tube is inserted into the inside of the fuel connecting tube, and a coil spring which biases the needle valve in a valve closing direction is disposed between the insert tube and the movable core.

As this type of fuel injection valve, a fuel injection valve having the following construction was previously proposed in Japanese Laid-Open Utility Model Publication 165965/1984. That is, a fixed core portion is provided at a distal end portion of a fuel connecting tube positioned in the inside of an electromagnetic solenoid. A movable core is disposed such that the movable core can be brought into contact with the distal end side of the fixed core portion. At the time of opening the valve upon actuation of the electromagnetic solenoid, the movable core which is integrally formed with a needle valve is electromagnetically attracted to the fixed core portion side so that a proximal end surface of the movable core portion is brought into contact with the distal end surface of the fixed core portion. At the time of closing the valve, the needle valve is slidably moved in a distal end side thereof due to a coil spring and also the fuel pressure, so that a valve element is brought into contact with a valve seat of a nozzle body, and so that the distal end surface of the movable core approaches an end surface of the nozzle body, thus closing the valve.

Although the fuel injection valve having such a structure gives rise to a gap between the distal end surface of the movable core and the end surface of the nozzle body at the time of closing the valve, since the gap is several hundred $\mu$m, and hence is extremely wide, the valve element of the needle valve which closes the valve due to a biasing spring force of a coil spring and also the fuel pressure strongly impinges on the valve seat of the nozzle body at the time of closing the valve. Here, a large impact occurs, thus giving rise to a problem that operating sound of a high level occurs. Further, since the impact at the time of closing the needle valve is large, the valve element is "bounced" at the time of closing the valve as a result of the impact. Hence, the valve is still slightly opened after the closing of the valve, thus leading to an unintended secondary injection due to this bouncing. Accordingly, there arises a problem that the metering performance of the fuel injection amount which can be accurately controlled based on the valve opening time is deteriorated.

SUMMARY OF THE INVENTION

It is an object of the present invention to provide a fuel injection valve which can reduce the operating sound at the time of closing a needle valve, and which can also prevent the deterioration of fuel metering performance which occurs as a result of bouncing of a valve element at the time of closing the valve.

The fuel injection valve of the present invention is constituted such that a needle valve and a movable core are movably disposed in an axial direction in the inside of a body which incorporates an electromagnetic solenoid therein, a fixed portion which the movable core approaches at the time of closing the valve is disposed in the body, and a gap is formed between the movable core and the fixed portion at the time of closing the valve. Here, when fuel remaining in the gap between the movable core and the fixed portion is pressurized corresponding to the movement of the movable core to the valve closing side, a squeezing portion is disposed at a portion which constitutes a passage for the fuel extruded from the gap.

It is effective if the size of the gap between the movable core and the fixed portion is set at 3.5 $\mu$m–32 $\mu$m.

Further, the squeezing portion which constitutes the passage for fuel extruded from the gap can be formed in the inside of a sleeve which is positioned at an outer periphery of the movable core.

Still further, the squeezing portion which constitutes the passage for fuel extruded from the gap can be formed by bulging an inner peripheral portion of a sleeve inwardly in a ring-like shape.

Further, an annular fixed member can be fixedly secured at a fixed position in the inside of the body as the fixed portion.

The fuel injection valve having the above-mentioned constitution is further provided with a nozzle body which is fitted into the distal end side of the body such that the nozzle body covers the needle valve from the outside, a valve seat formed around an injection opening provided at a distal end portion of the nozzle body, and a coil spring which biases the movable core to the distal end portion side.

Further, as another example, a nozzle body is fitted into the inside of the distal end of the body, an annular plate-like spacer is fitted between an inner peripheral shoulder portion of the body and a proximal end portion of the nozzle body, and a portion of the plate-like spacer which is protruded in the inside of the nozzle body is formed as the fixed portion.

Further, in the fuel injection valve which fixedly secures the annular fixed member at a given position in the inside of the body, a small-diameter portion may be formed on the distal end side of a movable core, and a squeezing portion may be provided at an inner peripheral portion of the annular fixed member which guides an outer peripheral portion of the small diameter portion.

Still further, in the above-mentioned fuel injection valve, by partially adding a plate-like space or a wedge space in a gap formed between the movable core and the fixed portion, the squeezing reaction force applied to the movable core at the time of closing the valve may be adjusted.

In the fuel injection valve having such a constitution, at the time of opening the valve, upon excitation of the electromagnetic solenoid, the movable core is electromagnetically attracted and retracted together with the needle valve toward the proximal end side, that is, the fixed core portion side which compresses the coil spring. Accordingly, the valve element provided at a distal end of the needle valve is separated a given distance from the valve seat so as to open the valve, and the fuel is injected from the injection opening of the valve seat.

On the other hand, at the time of closing the valve, the electric signal to the electromagnetic solenoid is cut off to stop the excitation thereof and hence, the movable core and the needle valve are moved toward the distal end side due to a biasing force of the coil spring and also the fuel pressure. Accordingly, the valve element provided at the distal end of the needle valve comes into contact with the valve seat so as to close the valve. At this point of time, that is, at the time of moving the movable core in the valve closing direction, that is, toward the fixed portion, the fuel which remains in the gap formed between the proximal end surface of the fixed portion and the distal end surface of the movable core is sandwiched and receives a pressing force. This fuel passes through the squeezing portion, and is discharged through the gap formed between the proximal end surface of the movable core and the distal end surface of the fixed portion.

Here, the movable core generates the squeezing reaction force (reaction force against the squeezing-out force or pushing-out force generated at the time of pressurizing the liquid and squeezing the liquid through the gap). Since the squeezing reaction force is increased in an inversely proportional manner to the cube of the size of the gap between the movable core and the fixed portion, even when the gap between the two surfaces which face in an opposed manner (that is, the gap between the proximal end surface of the fixed portion and the distal end surface of the movable core) is small, a large squeezing reaction force is generated. Also, a quick braking force is applied to the movable core and the needle valve due to this squeezing reaction force slightly before the point of time when the valve is closed. Accordingly, at the time of closing the valve, the impinging speed (seating speed) at a point of time that the valve element impinges (seats) on the valve seat is reduced or attenuated, so that operating sound at the time of closing the valve can be reduced. Further, by reducing the impinging speed of the valve element, the bouncing generated in the valve element at the time of impinging can be suppressed. As a result, the secondary injection after closing the valve can be minimized and hence, the metering performance of the fuel injection can be enhanced.

DETAILED DESCRIPTION OF THE PREFERRED EMBODIMENTS

Figure 1:
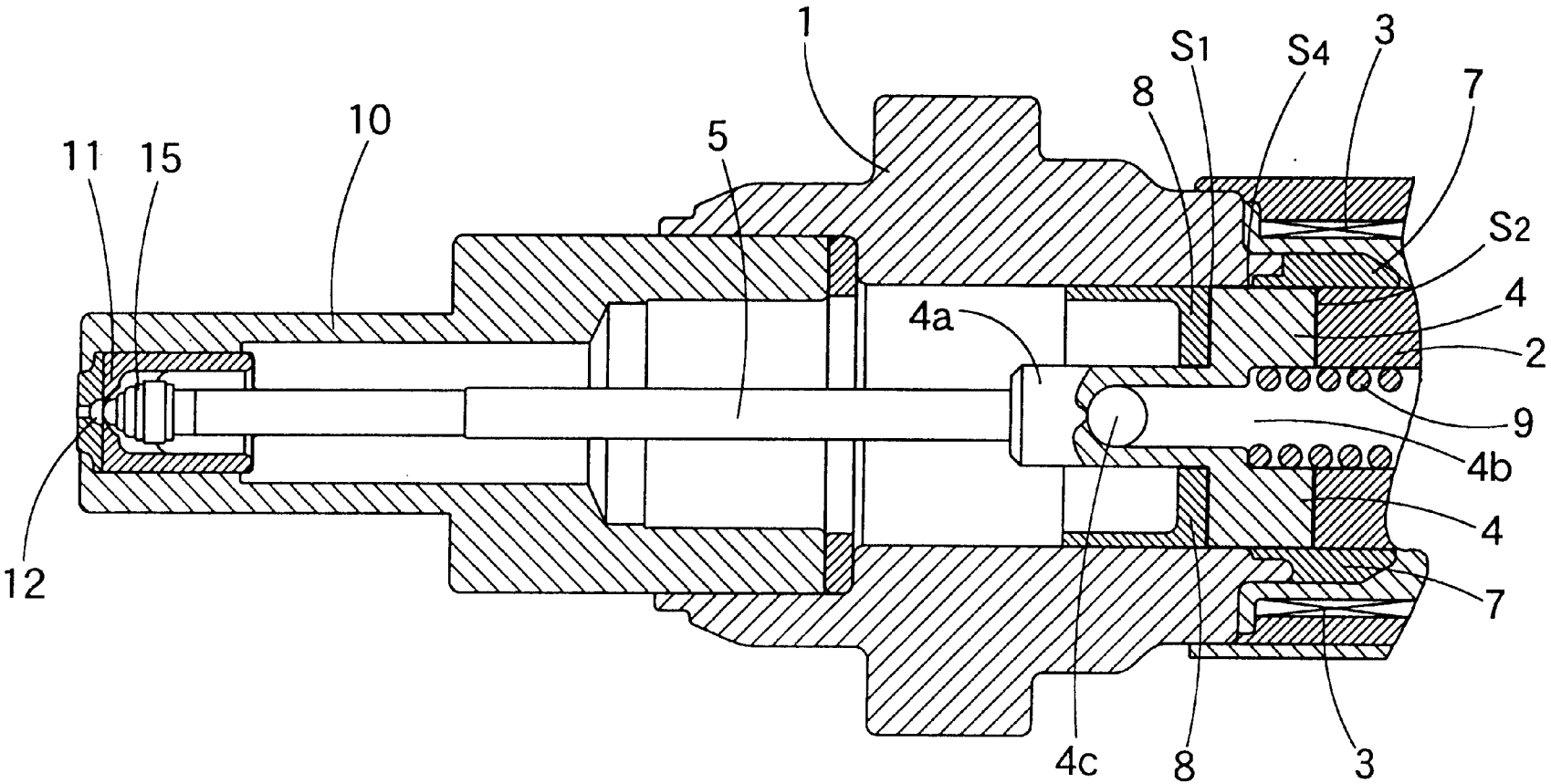
FIG. 1 is a cross-sectional view of a fuel injection valve of one embodiment of the present invention.

Embodiments of the present invention are explained hereinafter in conjunction with attached drawings. FIG. 1 shows an electromagnetic type fuel injection valve which is used in an internal combustion engine. The fuel injection valve is substantially constituted such that an electromagnetic solenoid 3 is disposed in a body 1, a movable core 4 made of magnetic material is slidably inserted into the inside of a body inner chamber formed in the inside of the electromagnetic solenoid 3, a needle valve 5 is mounted on a distal end side of the movable core 4, a nozzle body 10 is fitted on a distal end portion of the body 1 in such a manner that the nozzle body 10 surrounds the needle valve 5, and a fuel connecting tube not shown in the drawing is disposed in and fixedly secured to a proximal portion of the body 1.

A distal end portion of the fuel connection tube is made of magnetic material and is formed as a fixed core portion 2. The fixed core portion 2 is positioned in the inside of the electromagnetic solenoid 3, and the electromagnetic solenoid 3 is formed by winding an exciting coil in an annular manner on a bobbin made of synthetic resin. In the inside of the electromagnetic solenoid 3, a sleeve 7 is fixedly secured to an outer peripheral portion of a distal end of the fixed core portion 2. The sleeve 7 is made of non-magnetic material and is formed in a tubular shape. To guide the slide movement of the movable core 4, the proximal end of the movable core 4 is held in the inside of the sleeve 7 in a slidable manner.

The movable core 4 is formed such that it includes a column-like proximal portion and a small-diameter portion 4*a* which is integrally abutted to the distal end side of the proximal portion. An axial hole 4*b* is formed in the movable core 4 such that the axial hole 4*b* extends from the proximal portion to an intermediate portion of the small-diameter portion 4*a*. The axial hole 4*b* is communicated with through a through hole 4*c*, which is formed in a direction so as to transverse the small-diameter portion 4*a*. The axial hole 4*b* and the through hole 4*c* of the movable core 4 constitute a fuel passage, and the needle valve 5 is connected and fixedly secured to the distal end of the small-diameter portion 4*a*. An insert tube not shown in the drawing is inserted into the inside of the fuel connection tube, and a coil spring 9 is disposed between the insert tube and the movable core 4 so as to bias the movable core 4 toward the distal end side, that is, in the direction of closing the needle valve 5.

On the distal end side of the body 1, the nozzle body 10 is fitted in such a manner that the nozzle body 10 surrounds the distal end side of the needle valve 5. A valve seat 11 is formed on the distal end portion of the nozzle body 10, and an injection opening 12 is formed in the center of the valve seat 11. A conical valve element 15 is formed on the distal end of the needle valve 5, and the valve is closed when the valve element 5 is seated on the valve seat 11. Further, a fixed member 8 is fixedly secured at a given position in the inside of the body 1 located at the distal end side of the movable core 4. The fixed member 8 is formed by integrally providing an annular plate portion to a cylindrical proximal end portion. The small-diameter portion 4*a* of the movable core 4 is slidably inserted into a central hole formed in the annular plate portion.

Figure 2:
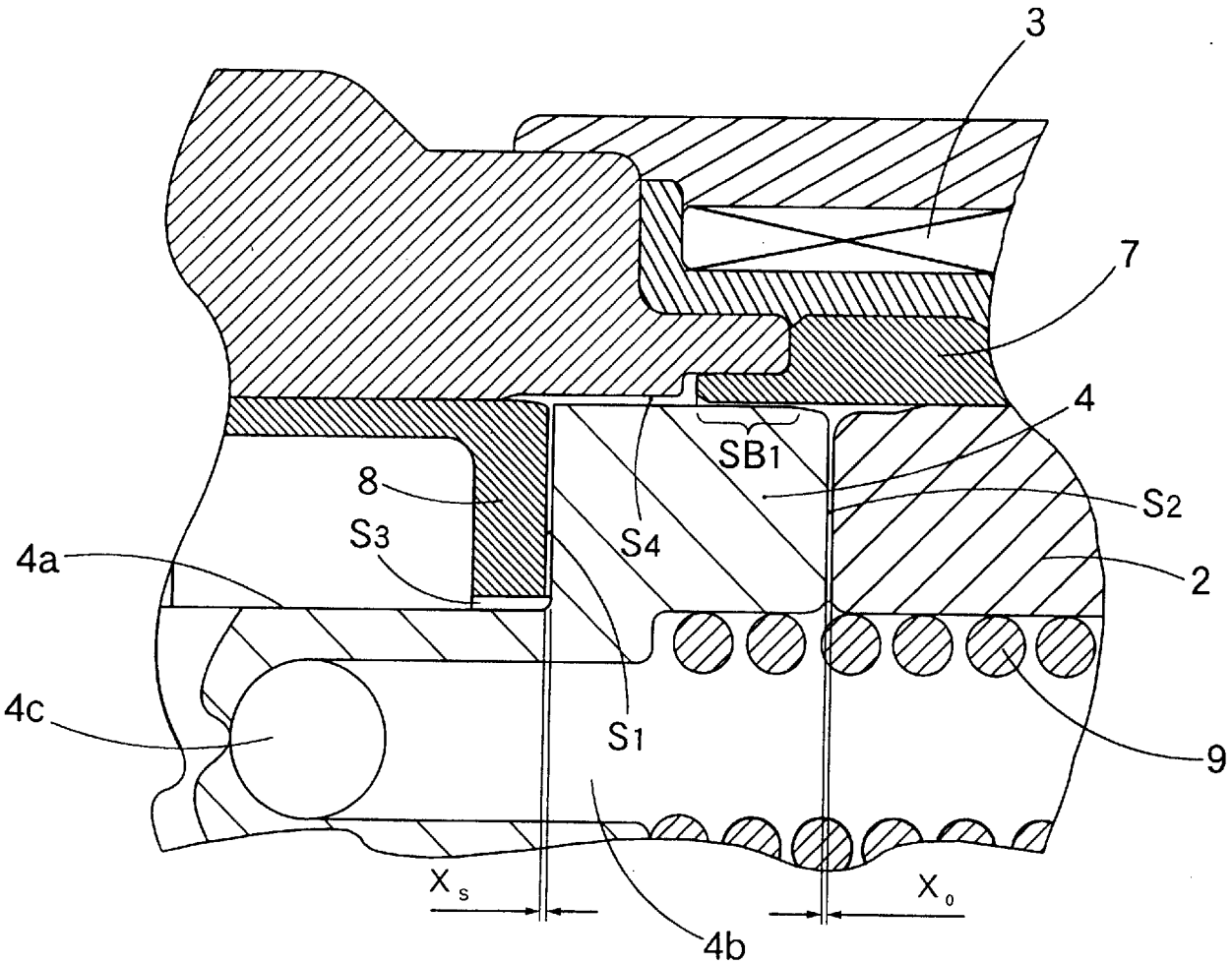
FIG. 2 is an enlarged cross-sectional view of the periphery of a movable core of the fuel injection valve.

The fixed member 8 is a member which is located at the location of the end of the movement of the movable core 4 toward the distal end side thereof, and is disposed such that the fixed member 8 faces the movable core 4 in an opposed manner. As shown in FIG. 2, which shows the enlarged essential cross-section at the time of closing the valve, at the time of closing the valve, that is, when the valve element 15 of the needle valve 5 comes into contact with the valve seat 11, a gap $S_1$ is formed between the distal end surface of the movable core 4 and the proximal end surface of the fixed member 8. The size of the gap $S_1$ is set to $X_s$. Further, a gap $S_2$ is formed between the proximal end surface of the movable core 4 and the distal end surface of the fixed core portion 2, and the size of the gap $S_2$ is set to $X_o$. This size $X_o$ of the gap $S_2$ defines the length of the movement stroke of the movable core 4.

Figure 3:
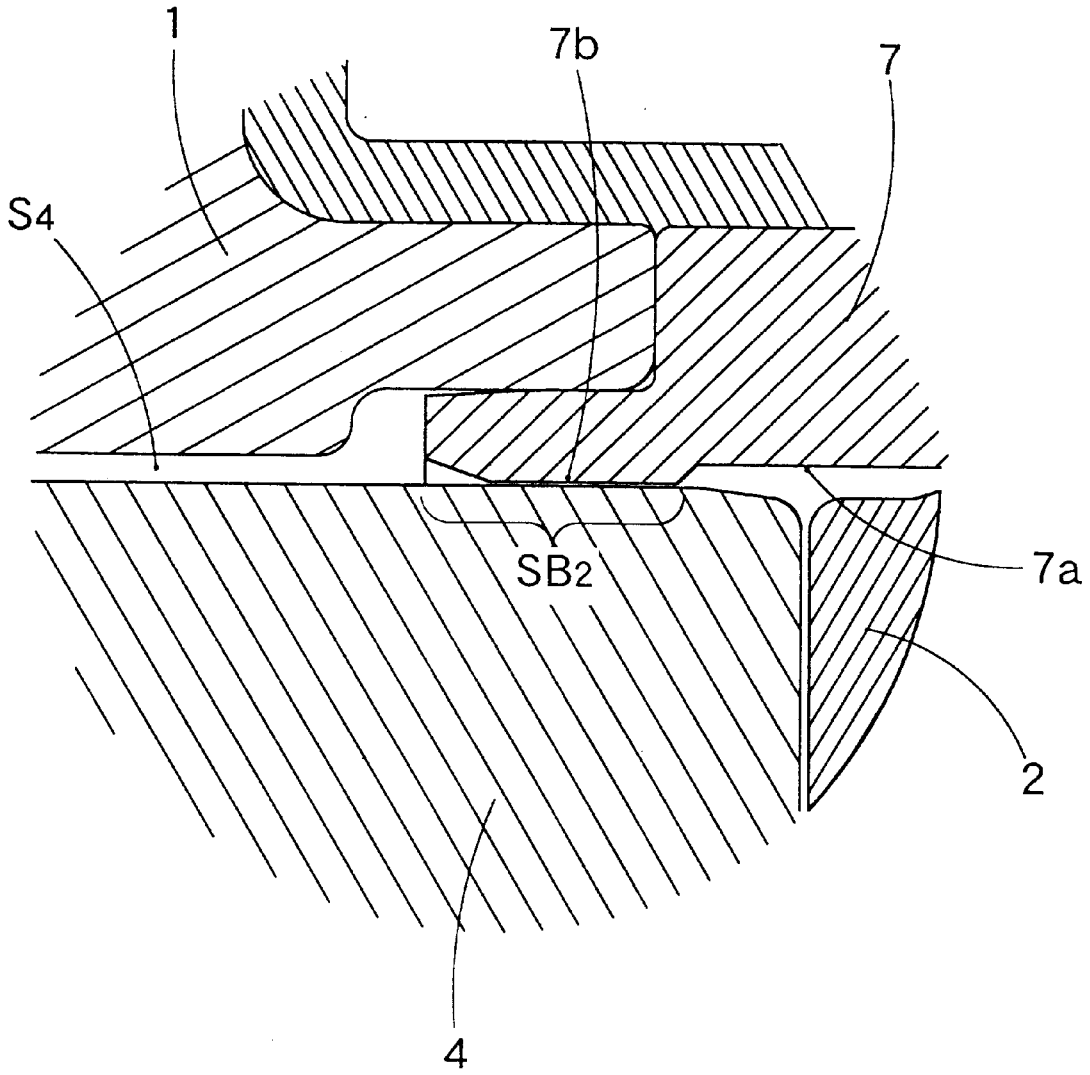
FIG. 3 is an enlarged cross-sectional view of the periphery of a movable core of the fuel injection valve of another embodiment of the present invention.

Further, a gap $S_3$ is formed between the outer peripheral surface of the small-diameter portion 4*a* of the movable core 4 and the inner peripheral surface of the annular plate portion of the fixed member 8. Also, a gap $S_4$ is formed between the outer peripheral surface of the movable core 4 and the inner peripheral surface of the body 1. A squeezing portion $SB_1$ is formed on the inside of the sleeve 7 and is disposed between the gap $S_4$ and the gap $S_2$. As shown in FIG. 3, a squeezing portion $SB_2$ which generates the squeezing reaction force may be formed by providing an annular bulged portion 7*b* which bulges inwardly from the inner peripheral surface 7*a* of the sleeve 7.

The fuel injection valve having the above-mentioned configuration is mounted on a cylinder head or the like for directly injecting the fuel into an intake system and a combustion chamber of an internal combustion engine. The electromagnetic solenoid 3 is connected to a drive circuit, and a connector portion of the fuel connection tube is connected to a delivery pipe. When the electromagnetic solenoid 3 is excited by the drive circuit under the condition that the fuel is supplied to the fuel connection tube from the delivery pipe, the movable core 4 is magnetically attracted and moved toward the proximal end side. This allows the movable core 4 to compress the coil spring 9. Simultaneously, the needle valve 5 is moved in the same direction, and the valve element 15 is moved away from the valve seat 1 so as to establish a valve-opened condition. Here, fuel is injected from the injection opening 12 of the valve seat 11.

On the other hand, at the time of closing the valve, the supply of electric signals to the electromagnetic solenoid 3 is cut off so as to stop the excitation of the electromagnetic solenoid 3. Accordingly, the movable core 4 and the needle valve 5 are moved toward the distal end side due to the biasing force of the coil spring 9 and also the fuel pressure. Then, the valve element 15 formed on the distal end of the needle valve 5 comes into contact with the valve seat 11 so as to close the valve.

Here, at the time of moving the movable core 4 in the valve closing direction, that is, toward the fixed member 8, the fuel remaining in the gap $S_1$ formed between the proximal end surface of the fixed member 8 and the distal end surface of the movable core 4 is sandwiched and receives a compression force, thus generating the squeezing action. That is, the fuel which has received the pressure passes through the squeezing portion $SB_1$ from the gap $S_4$ of the outer peripheral portion of the movable core 4, and then passes through the gap $S_2$ formed between the proximal end surface of the movable core 4 and the distal end surface of the fixed core portion 2. Finally, the fuel is squeezed out into the fuel passage formed in the inside of the movable core 4. Further, a part of the fuel remaining in the gap $S_1$ passes through the gap $S_3$ formed between the outer peripheral surface of the small-diameter portion 4*a* of the movable core 4 and the inner peripheral portion of the annular plate portion of the fixed member 8. The fuel is then also squeezed out into the fuel passage formed in the inside of the fixed member 8. In this case, the gap $S_3$ functions as a squeezing portion.

At the time of generating such a valve closing squeeze, the squeezing reaction force(i.e., the reaction force against the squeezing-out force or pushing-out force generated at the time of pressurizing a liquid and squeezing a liquid through the gap) is generated on the movable core 4, such that the movable core 4 presses the fuel to the proximal end surface of the fixed member 8. Since the squeezing reaction force is increased in an inversely proportional manner to the cube of the size of the gap $S_1$ formed between the movable core 4 and the fixed member 8, a braking force due to this squeezing reaction force is quickly applied to the movement of the movable core 4. The needle valve 5 slightly before the point of time that the valve is closed. Accordingly, at the time of closing the valve, the impinging speed (seating speed) at a point of time that the valve element 15 impinges (seats) on the valve seat 11 is reduced or attenuated, so that operating sound at the time of closing the valve can be effectively reduced. Further, by reducing the impinging speed of the valve element 15, the bouncing generated in the valve element 15 at the time of impinging can be suppressed whereby the secondary injection after closing the valve can be minimized. As a result, the metering performance of the fuel injection can be enhanced.

Figure 4:
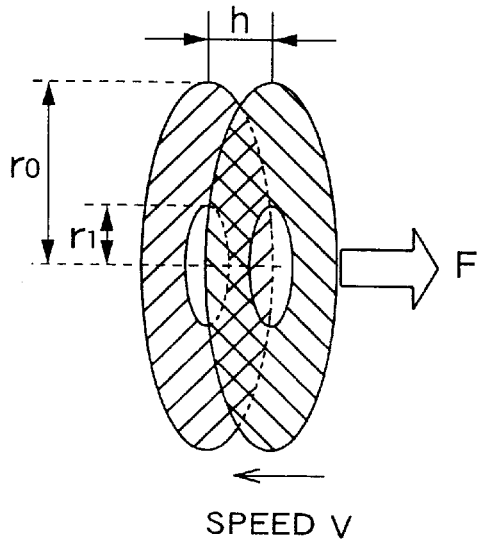
FIG. 4 is an explanatory view at the time of generating squeezing occurs between two annular discs.

Meanwhile, as shown in FIG. 4, under the condition that liquid is filled between two sheets of annular discs such that these discs are capable of generating squeezing, when one annular disc is moved and pressed toward another annular disc at a speed v and the size of a gap between them becomes h, the squeezing reaction force F generated on one annular disc can be calculated by the following formula, wherein the viscosity coefficient of the liquid is indicated by $\mu$, the outer diameter of the annular disc is indicated by $r_0$, the size of the gap is indicated by h, and the inner radius is indicated by $r_1$.

$$F=(3\pi\mu v/2h^3)\times\{(r_0^4-r_1^4)-(r_0^2-r_1^2)^2/\log|r_0/r_1|\}$$

Accordingly, as can be understood from the above formula, the squeezing reaction force F is inversely proportional to the cube of the size h of the gap, and is quickly increased corresponding to the decrease or narrowing of the gap between two sheets of annular discs. Meanwhile, substantially no reaction force is generated in the range where the gap is large. Accordingly, with respect to the fuel injection valve having the above-mentioned configuration, the reaction force does not give rise to any influence on the valve opening and closing operation of the needle valve 5, that is, on the responsive performance.

Figure 5:
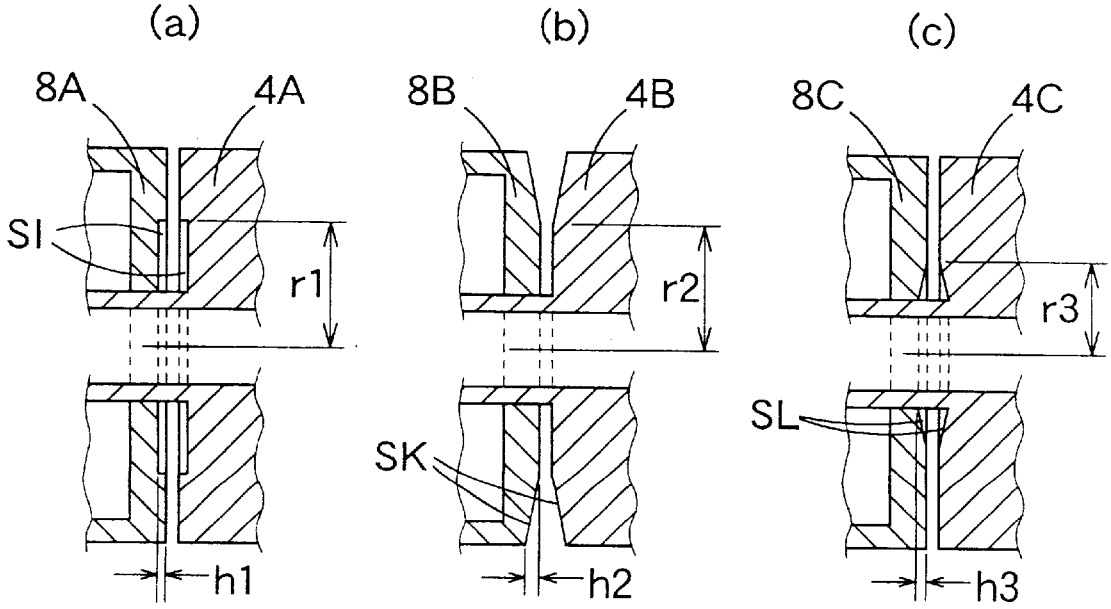
FIG. 5 is an explanatory view explaining the adjustment of the amount of the squeezing reaction force performed by forming a plate-like space or a wedge-like space between the fixed member and the movable core.

Further, as shown in FIG. 5, a plate-like space or a wedge-like space may be formed between the proximal end surface of the fixed member 8 and the distal end surface of the movable core 4, and the magnitude or the amount of the squeezing reaction force may be adjusted by adjusting the size of the space. That is, FIG. 5(*a*) shows an example where a plate-like space SI is formed between the proximal end surface of a fixed member 8A and the distal end surface of a movable core 4A. The squeezing reaction force which acts on the movable core 4A can be adjusted by changing the size of the plate-like space SI, that is, the sizes of h1 and r1. Further, FIG. 5(*b*) shows an example where a wedge-like space SK is formed at the outer peripheral side between the proximal end surface of a fixed member 8B and the distal end surface of a movable core 4B. The squeezing reaction force which acts on the movable core 4B can be adjusted by changing the size of the wedge-like space SK, that is, the sizes of h2 and r2. Further, FIG. 5(*c*) shows an example where a wedge-like space SL is formed at the inner peripheral side between the proximal end surface of a fixed member 8C and the distal end surface of a movable core 4C. The squeezing reaction force which acts on the movable core 4C can be adjusted by changing the size of the wedge-like space SL, that is, the sizes of h3 and r3.

Figure 6:
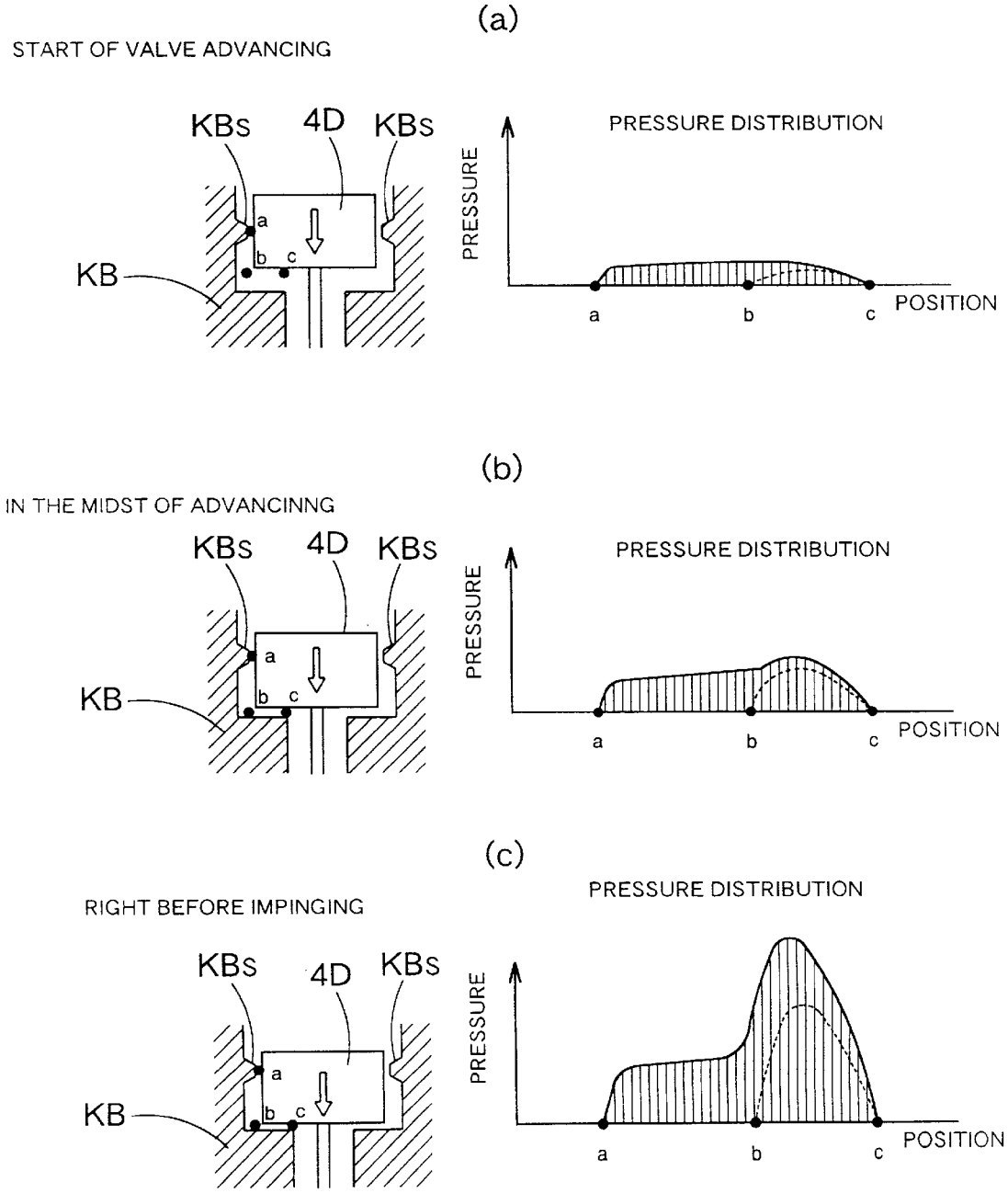
FIG. 6 is an explanatory view confirming an effect of increasing the squeezing reaction force acting on the movable core due to the provision of the squeezing portion through a computer simulation. Here, (a) includes a schematic view and a graph showing the pressure distribution of the inside of an inner space at the time of starting the advancing of the valve, (b) includes a schematic view and a graph showing the pressure distribution of the inside of the inner space in the course of the advancing of the valve, and (c) includes a schematic view and a graph showing the pressure distribution of the inside of the inner space just before the seating of a valve element on a valve seat.

FIG. 6 is an explanatory view using a computer simulation for confirming the effect that the squeezing reaction force which acts on the movable core 4 can be increased with the provision of the above-mentioned squeezing portions $SB_1$, $SB_2$ Here, KB indicates a virtual body, and 4D indicates a virtual movable core inserted into the inside of the virtual body 4D. The pressure in the inside of the body KB at the time of moving the movable core 4D in a downwards direction under the condition that the liquid remains in the inside of the body KB is calculated at respective positions a, b, c in two cases: that is, with respect to a case where a squeezing portion $KB_s$ is formed in the inside of the body KB, and a case where the squeezing portion $KB_s$, is not formed in the inside of the body KB, and the pressure distribution at respective moved positions is indicated. Solid lines in the pressure distribution graphs indicate the pressure distribution in the case where the squeezing portion $KB_s$ is formed, and dashed lines in the pressure distribution graphs indicate the pressure distribution in the case where the squeezing portion $KB_s$ is not formed. It is understood from the respective pressure distribution graphs of FIG. 6 that by providing the squeezing portion $KB_s$ at the inside of the body KB, the pressure (squeezing reaction force) which acts on the distal end surface side of the movable core 4D can be considerably increased.

Figure 7:
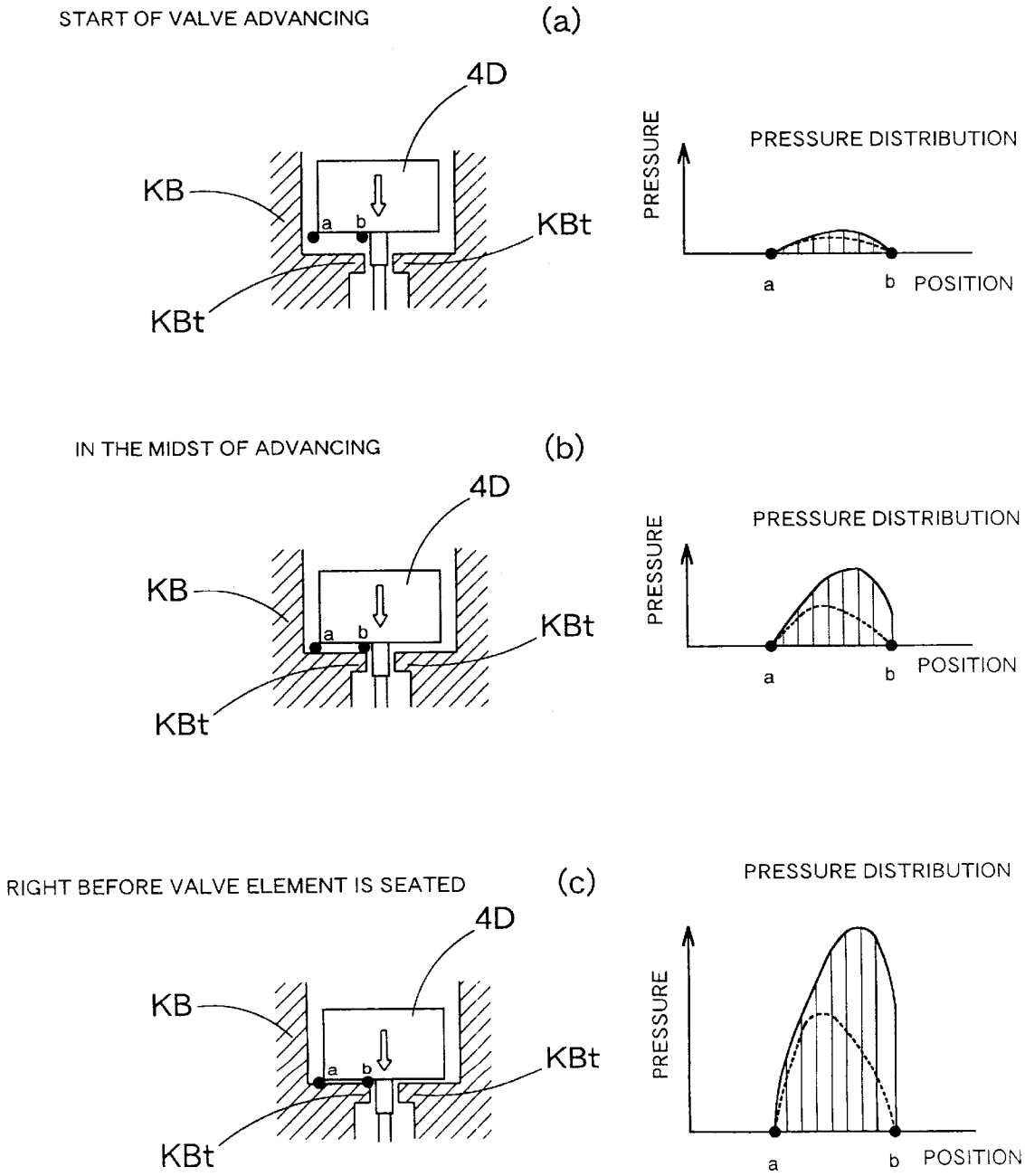
FIG. 7 is an explanatory view confirming an effect of increasing the squeezing reaction force acting on the movable core in the case where the squeezing portion is formed on the outer periphery of the small-diameter portion of the movable core as shown by a computer simulation. Here, (a) includes a schematic view and a graph showing the pressure distribution of the inside of an inner space at the time of starting the advancing of the valve, (b) includes a schematic view and a graph showing the pressure distribution of the inside of the inner space in the course of the advancing of the valve, and (c) includes a schematic view and a graph showing the pressure distribution of the inside of the inner space just before seating of a valve element on a valve seat.

FIG. 7 is an explanatory view for confirming an effect which is obtained by forming the gap $S_3$ between the outer peripheral surface of the small-diameter portion 4*a* of the movable core 4, and the inner peripheral surface of the annular plate-like portion of the fixed member 8 in FIG. 2. Here, the gap $S_3$ is made to work as a squeezing portion. Here, the pressure in the inside of the body KB at the time of moving the movable core 4D downwardly under the condition that the liquid remains in the inside of the body KB is calculated at respective positions a, b, c with respect to two cases: that is, a case where a squeezing portion $KB_t$ is formed on the periphery of a small-diameter portion of a virtual movable core 4D in the inside of a virtual body KB, and a case where the squeezing portion $KB_t$ is not formed on such periphery of the small-diameter portion of a virtual movable core 4D, and the pressure distribution at respective moved positions is indicated. Solid lines in the pressure distribution graphs indicate the pressure distribution in the case that the squeezing portion KBt is formed and dashed lines in the pressure distribution graphs indicate the pressure distribution in the case where the squeezing portion $KB_t$ is not formed. It is understood from the respective pressure distribution graphs of FIG. 7 that by providing the squeezing portion $KB_t$ at the inside of the body KB, the pressure (squeezing reaction force) which acts on the distal end surface side of the movable core 4D can be considerably increased.

Figure 8:
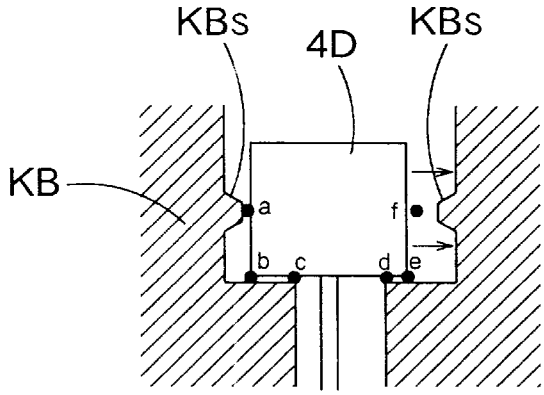
FIG. 8 is an explanatory view explaining a force which acts so as to perform centering of the movable core, wherein (a) is a schematic view thereof, (b) are pressure distribution graphs at positions a–c, and (c) are pressure distribution graphs at positions d–f.
Figure 8:
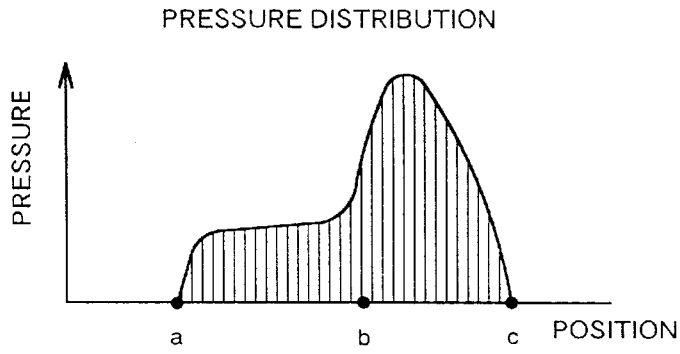
Figure 8:
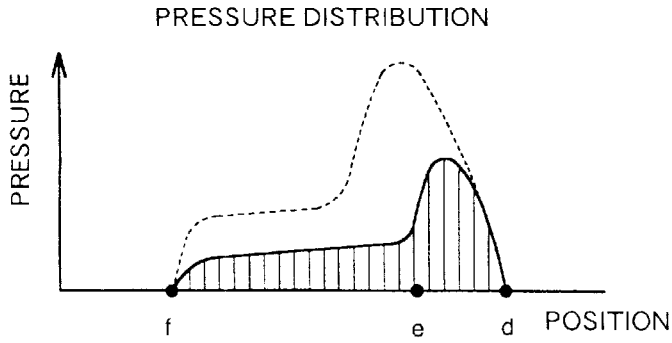

Further, FIG. 8 shows the result obtained by calculating, using a computer simulation, the pressure distribution in the case where the position of the movable core is offset with respect to the virtual body KB provided with the squeezing portion KBs, and the virtual movable body 4D. It is understood that, due to the difference of pressure at respective positions a–e in the inside of the body KB in FIGS. 8(*b*),(*c*), in case the movable core 4D is offset and approaches one squeezing portion KBs, the pressure of the moving distal end surface (positions b,c) of this squeezing portion KBs side is increased compared to the pressure of other portions. From this result, it is understood that due to the increase of the pressure at the offset narrow side, a force which pushes the movable core to the opposite side acts on the movable core so that a force which moves the movable core in the direction to perform the centering of the movable core, that is, in the direction to cancel the offset is produced thus realizing the automatic correction of the offset.

Figure 9:
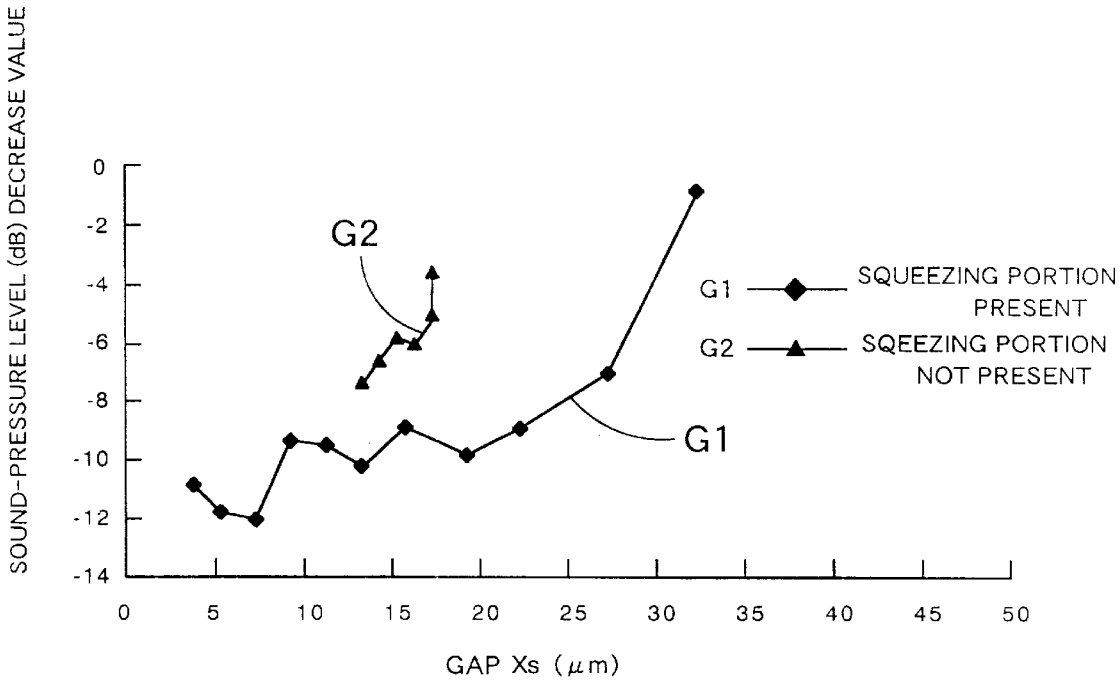
FIG. 9 is a graph showing the change of the sound-pressure level decrease value of operating noise when the size $X_s$ of the gap $S_1$ is changed with respect to the embodiment of the present invention and a comparison example.

Further, FIG. 9 shows a graph obtained by the measuring the sound-pressure level of the operating sound of the fuel injection valve under the condition that the size $X_s$ of the gap $S_1$ formed between the movable core 4 and the fixed member 8 at the time of closing the valve is changed with respect to the embodiment of the present invention (having the squeezing portion) and a comparison example (having no squeezing portion). This graph uses the operating sound of a conventional fuel injection valve (having a large gap at the distal end side of the movable core at the time of closing the valve which is set to several hundred $\mu$m) as the reference, and indicates the extent of the decrease value of the sound-pressure level from this operating sound of the conventional fuel injection valve. The graph G1 indicates the decrease value of the sound-pressure level in the case where the size $X_s$ of the gap $S_1$ formed between the movable core 4 and the fixed member 8 at the time of closing the valve is changed within the range of 3.5 $\mu$mm–32 $\mu$m with respect to the fuel injection valve of the embodiment of the present invention as shown in FIG. 1 and FIG. 2. The graph G2 indicates the decrease value of the sound-pressure level in the case where the size $X_s$ of the gap $S_1$ formed between the movable core 4 and the fixed member 8 is changed within the range of 13 μm–17 μm with respect to a fuel injection valve which is equivalent to the fuel injection valve of the embodiment of the present invention as shown in FIG. 1 and FIG. 2, but which is not provided with the squeezing portion $SB_1$.

It is understood from the graph GI of FIG. 9 that by setting the size $X_s$ of the gap $S_1$ formed between the movable core 4 and the fixed member 8 to a small value which falls within the range of 3.5 μm–32 μm as shown in FIG. 1 and FIG. 2, and while providing the squeezing portion $SB_1$, the sound level of the operating sound can be reduced by an extent of from approximately 1 dB to approximately 12 dB as compared with the soundlevel of the conventional fuel injection valve. Further, as can be understood from the graph G2 of FIG. 9, by setting the size $X_s$ of the gap $S_1$, formed between the movable core 4 and the fixed member 8 at the time of closing the valve to a small value which falls within the range of 13 μm–17 μm, the sound level of the operating sound can be reduced by an extent of from approximately 3 dB to approximately 8 dB as compared with the conventional fuel injection valve, even when the squeezing portion $SB_1$ shown in FIG. 1 and FIG. 2 is not provided. Further, it is understood that, in the case where the squeezing portion $SB_1$ is provided, by setting the size $X_s$ of the gap $S_1$ at the time of closing the valve to a small value which falls within the range of 3.5 μm–22 μm, the sound level of the operating sound can be definitely reduced as compared with the case where the squeezing portion is not provided. Meanwhile, in the case where the size $X_s$ of the gap $S_1$ is set to a value below 3.5 μm, depending on a dimensional error that occurs in designing, a failure may arise that the opposing surfaces come into contact with each other. Meanwhile in the case where the size $X_s$ of the gap $S_1$ is set to a value above 32 μm, it becomes difficult to achieve the desired reduction of the operating sound.

Figure 10:
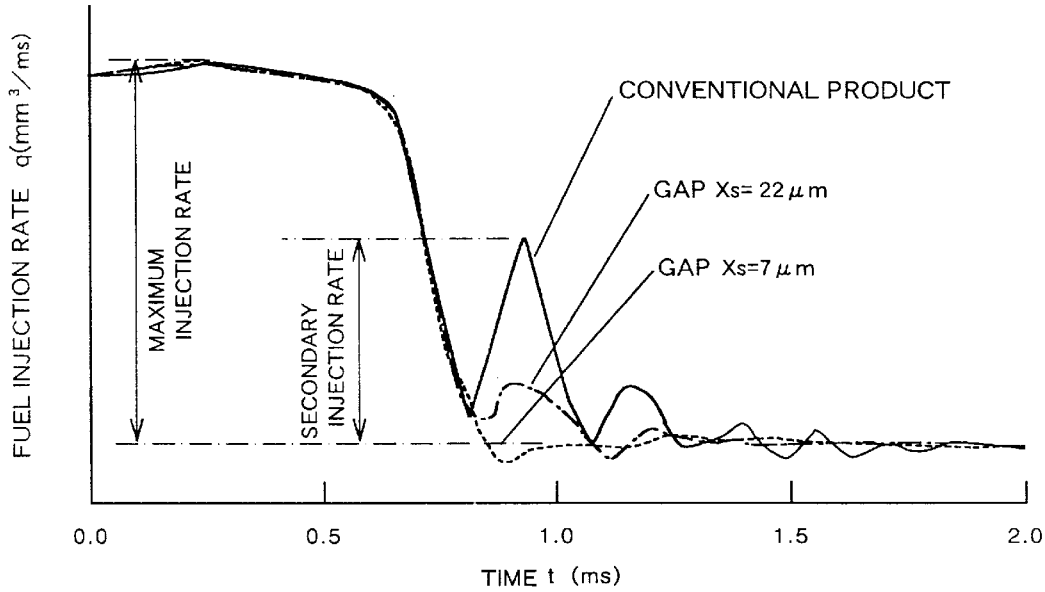
FIG. 10 is a graph showing the change of the fuel injection ratio of the fuel injection valve with respect to the embodiment of the present invention and a comparison example.
Figure 11:
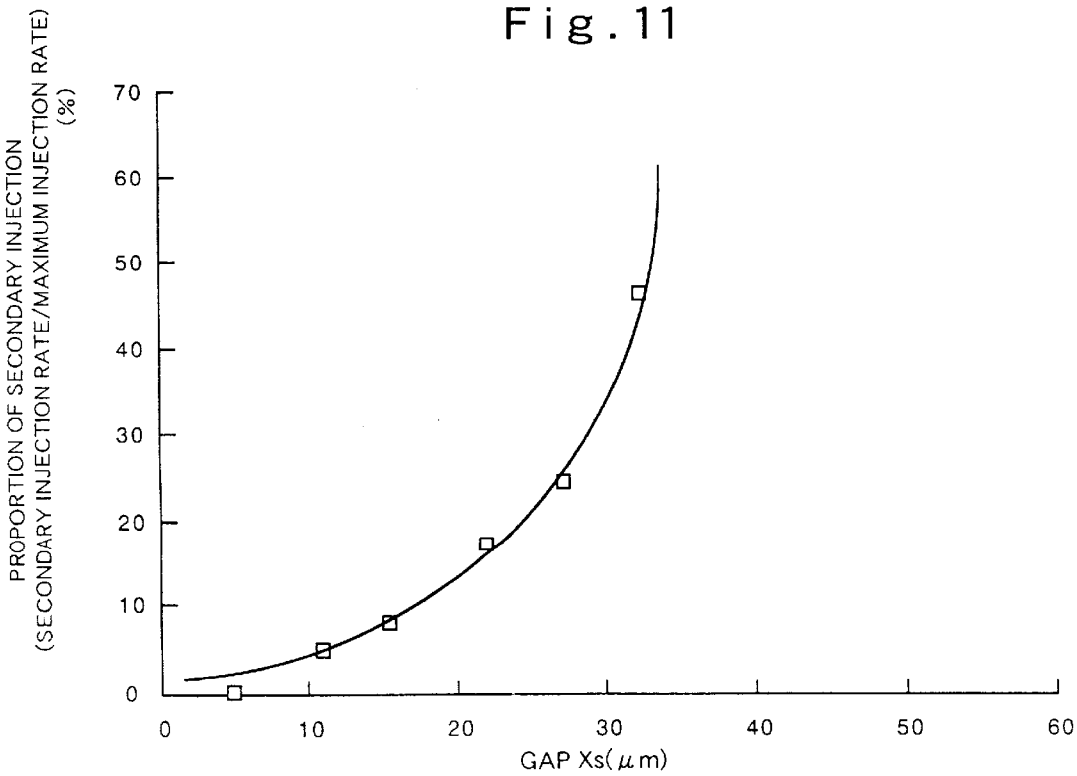
FIG. 11 is a graph showing the change of the secondary injection rate of the fuel injection valve when the size $X_s$ of the gap $S_1$ is changed with respect to the embodiment of the present invention.

Further, FIG. 10 and FIG. 11 show graphs which are obtained by measuring and calculating the change of fuel injection amount as time elapses and the proportion or ratio of the secondary injection (secondary injection rate/maximum injection rate) for the size $X_s$ of the gap $S_1$ at the time of closing the valve. It is understood from the graph of FIG. 10 that a large secondary injection having an injection rate of not less than 50% occurs after the primary injection in the conventional fuel injection valve which is not provided with the squeezing portion at a portion which defines a passage for fuel extruded in response to the valve closing movement of the movable core. It is also understood from the graph of FIG. 10 that, in the case where the squeezing portion $SB_1$ is formed in the portion which defines the fuel extruding passage, and where the size $X_s$ of the gap $S_1$ at the time of closing the valve is set to 22 μm as in the case of the embodiment of the present invention, the secondary injection rate can be largely reduced. Further, in the case where the size $X_s$ of the gap $S_1$ at the time of closing the valve is set to 7 μm, the secondary injection rate is further reduced. Moreover, it is understood from the graph of FIG. 11 that in correspondence with the narrowing of the size $X_s$ of the gap $S_1$ in the embodiment of the present invention to 11 μm and then 5 μm in stages, the secondary injection rate becomes smaller, and thus becomes the most favorable value.

Figure 12:
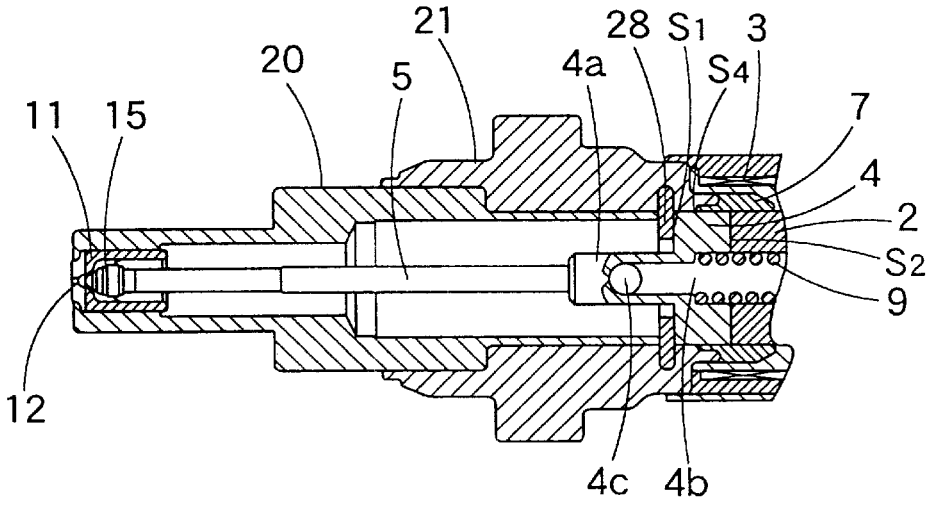
FIG. 12 is a cross-sectional view of the fuel injection valve of another embodiment.

FIG. 12 shows the fuel injection valve of another embodiment. This fuel injection valve adopts a structure whereby a spacer 28 is used in place of the fixed member 8 in the above-mentioned embodiment as shown in FIG. 1. The spacer 28 is fitted between the proximal end portion of the nozzle body 20 and an inner shoulder portion of the body 21, and the distal end surface of the movable core 4 is made to face the surface of the spacer 28 in an opposed manner. The fuel injection valve has the same structure as the fuel injection valve of the above-mentioned embodiment shown in FIG. 1 with respect to the electromagnetic solenoid 3, the sleeve 7, the movable core 4 and the like. As in the case of the structure shown in FIG. 2, on the outer peripheral portion of the movable core 4, a squeezing portion is formed between the sleeve 7 and the movable core 4, the gap $S_1$ is formed between the distal end surface of the movable core 4 and the proximal end surface of the spacer 28, and the gap $S_2$ is formed between the proximal end surface of the movable core 4 and the distal end surface of the fixed core portion 2.

At the time of closing this fuel injection valve, when the movable core 4 is moved in the valve closing direction, the fuel which remains in the gap $S_1$ formed between the proximal end surface of the spacer 28 and the distal end surface of the movable core 4 is sandwiched by these surfaces and receives a pressing force. In the same manner as in the previously mentioned embodiment, the fuel passes through the squeezing portion from a gap $S_4$ formed on the outer peripheral portion of the movable core 4, and then passes through the gap $S_2$ formed between the proximal end surface of the movable core 4 and the distal end surface of the fixed core portion 2. Thereafter, the fuel is squeezed out into the fuel passage formed in the inside of the movable core 4, thus generating the squeeze.

At the time of generating such a valve closing squeeze, a squeezing reaction force is generated on the movable core 4 which acts to press the fuel to the proximal end surface of the spacer 28. Due to this squeezing reaction force, a braking is quickly applied to the movement of the movable core 4 and the needle valve 5 just before the closing of the valve. Accordingly, in the same manner as the previously mentioned embodiment, the impinging speed of the valve element 15 when the valve element 15 impinges on the valve seat 11 at the time of closing the valve is reduced, so that the operating sound at the time of closing the valve can be effectively reduced. Further, corresponding to the reduction of the impinging speed of the valve element 15, the bouncing which is generated on the valve element 15 at the time of impinging is suppressed, so that the secondary injection after closing the valve can be drastically reduced.

Figure 13:
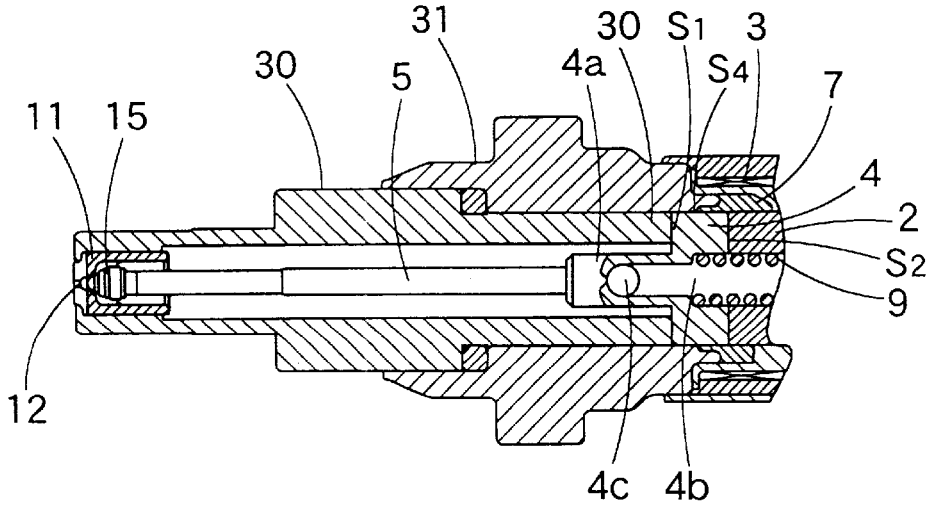
FIG. 13 is a cross-sectional view of the fuel injection valve of still another embodiment.

FIG. 13 shows a fuel injection valve of still another embodiment. This fuel injection valve adopts a structure whereby the above-mentioned spacer 28 or the like is not used, and the distal end surface of the movable core 4 is made to directly face the proximal end portion of the nozzle body 30 in an opposed manner. The fuel injection valve has the same structure as the fuel injection valve of the above-mentioned embodiment as shown in FIG. 1 and FIG. 12 with respect to the electromagnetic solenoid valve 3, the sleeve 7, the movable core 4 and the like. As in the case of the structure shown in FIG. 2 and FIG. 12, on the outer peripheral portion of the movable core 4, a squeezing portion is formed between the sleeve 7 and the movable core 4, the gap $S_1$ is formed between the distal end surface of the movable core 4 and the proximal end surface of a nozzle body 30, and the gap $S_2$ is formed between the proximal end surface of the movable core 4 and the distal end surface of the fixed core portion 2.

At the time of closing this fuel injection valve, when the movable core 4 is moved in the valve closing direction, the fuel which remains in the gap $S_1$ formed between the proximal end surface of the nozzle body 30 and the distal end surface of the movable core 4 is sandwiched by these surfaces and receives a pressing force. In the same manner as the previously mentioned embodiments, the fuel passes through the squeezing portion from a gap $S_4$ formed on the outer peripheral portion of the movable core 4, and then passes through the gap $S_2$ formed between the proximal end surface of the movable core 4 and the distal end surface of the fixed core portion 2. Thereafter, the fuel is squeezed out into the fuel passage formed in the inside of the movable core 4, thus generating the squeeze.

At the time of generating such a valve closing squeeze, a squeezing reaction force Is generated on the movable core 4, which acts to press the fuel to the proximal end surface of the nozzle body 30. Due to this squeezing reaction force, a braking is quickly applied to the movement of the movable core 4 and the needle valve 5 right before the closing of the valve. Accordingly, in the same manner as in the previously mentioned embodiment, the impinging speed of the valve element 15 when the valve element 15 impinges on the valve seat 11 at the time of closing the valve is reduced, so that the operating sound at the time of closing the valve can be reduced. Further, in correspondence with the reduction of the impinging speed of the valve element 15, the bouncing which is generated on the valve element 15 at the time of impinging is suppressed, so that the secondary injection after closing the valve can be drastically reduced.

As has been described heretofore, according to the fuel injection valve of the present invention, at the time of closing the valve, a squeezing reaction force is generated on the movable core. Since the squeezing reaction force is increased in an inversely proportional manner to the cube of the size of the gap between the movable core and the fixed member, even when the gap between the proximal end surface of the fixed portion and the distal end surface of the movable core is small, a large squeezing reaction force is generated. Further, quick braking is applied to the movable core and the needle valve due to this squeezing reaction force, just slightly before the point of time when the valve is closed. Accordingly, the impinging speed of the valve element when the valve element impinges on the valve seat at the time of closing the valve is reduced and hence, the operating sound at the time of closing the valve is reduced. Further, due to the reduction of the impinging speed of the valve element, the bouncing which is generated on the valve element at the time of impinging can be suppressed and the secondary injection after closing the valve can be minimized so that the fuel injection metering performance can be enhanced.

What is claimed is:

1. A fuel injection valve comprising;

a) a body;

b) an electromagnetic solenoid disposed in the inside of said body;

c) a movable core movable in the axial direction and disposed in the inside of said electromagnetic solenoid;

d) a needle valve fixedly secured to the distal end of said movable core, said needle valve disposed in the inside of said body such that said needle valve is movable in the axial direction;

e) a fixed portion disposed at a given position in the inside of said body such that said movable core approaches said fixed portion at the time said needle valve in the valve is moved in the closing direction, and such that a gap is formed between said fixed portion and said movable core at the time when said valve is being closed; and f) squeezing means being operable such that when fuel which remains in the gap formed between said movable core and said fixed portion is pressurized in correspondence with the movement of said movable core toward the valve closing side, said flow of fuel is squeezed at a portion which defines a passage for the fuel extruded through said gap.

2. A fuel injection valve according to claim 1, wherein the size of the gap formed between said movable core and the fixed portion is set at 3.5 $\mu$m–32 $\mu$m.

3. A fuel injection valve according to claim 1, wherein said squeezing means is formed by a squeezing portion which is disposed in the inside of a sleeve positioned on the outer periphery of said movable core.

4. A fuel injection valve according to claim 1, wherein an annular fixed member which forms said fixed portion is fixedly secured at a given position in the inside of said body.

5. A fuel injection valve according to claim 1, wherein the fuel injection valve further includes a nozzle body which is fitted to the distal end side of said body such that said nozzle body covers said needle valve from outside, a valve seat formed around an injection opening formed in a distal end portion of said nozzle body, and a coil spring which biases said movable core to the distal end portion side.

6. A fuel injection valve, comprising:

a) a body;

b) an electromagnetic solenoid disposed in the inside of said body;

c) a movable core movable in an axial direction and disposed in an inside of said electromagnetic solenoid;

d) a needle valve fixedly secured to a distal end of said movable core, said needle valve disposed in the inside of said body such that said needle valve is movable in the axial direction;

e) a fixed portion disposed at a given position in the inside of said body such that said movable core approaches said fixed portion at a time said needle valve in the valve is moved in a closing direction, and such that a gap is formed between said fixed portion and said movable core at the time when said valve is being closed; and f) squeezing means being operable such that when fuel which remains in the gap formed between said movable core and said fixed portion is pressurized in correspondence with the movement of said movable core toward the valve closing side, said flow of fuel is squeezed at a portion which defines a passage for the fuel extruded through said gap, wherein said squeezing means is formed by a squeezing portion which is disposed in the inside of a sleeve positioned on an outer periphery of said movable core and wherein the squeezing portion which forms said squeezing means is formed by bulging inwardly an inner peripheral portion of the sleeve in a ring-like shape.

7. A fuel injection valve comprising:

a) a body;

b) an electromagnetic solenoid disposed in the inside of said body;

c) a movable core movable in an axial direction and disposed in an inside of said electromagnetic solenoid;

d) a needle valve fixedly secured to a distal end of said movable core, said needle valve disposed in the inside of said body such that said needle valve is movable in the axial direction;

e) a fixed portion disposed at a given position in the inside of said body such that said movable core approaches said fixed portion at a time said needle valve in the valve is moved in a closing direction, and such that a gap is formed between said fixed portion and said movable core at the time when said valve is being closed; and f) squeezing means being operable such that when fuel which remains in the gap formed between said movable core and said fixed portion is pressurized in correspondence with the movement of said movable core toward the valve closing side, said flow of fuel is squeezed at a portion which defines a passage for the fuel extruded through said gap, wherein a nozzle body is fitted into an inside of a distal end of said body, an annular plate-like spacer is fitted between an inner peripheral shoulder portion of said body and a proximal end portion of said nozzle body, and a portion of the plate-like spacer which protrudes toward the inside of said nozzle body is formed as the fixed portion.

8. A fuel injection valve, comprising:

a) a body;

b) an electromagnetic solenoid disposed in the inside of said body;

c) a movable core movable in an axial direction and disposed in an inside of said electromagnetic solenoid;

d) a needle valve fixedly secured to a distal end of said movable core, said needle valve disposed in the inside of said body such that said needle valve is movable in the axial direction;

e) a fixed portion disposed at a given position in the inside of said body such that said movable core approaches said fixed portion at a time said needle valve in the valve is moved in a closing direction, and such that a gap is formed between said fixed portion and said movable core at the time when said valve is being closed; and f) squeezing means being operable such that when fuel which remains in the gap formed between said movable core and said fixed portion is pressurized in correspondence with the movement of said movable core toward the valve closing side, said flow of fuel is squeezed at a portion which defines a passage for the fuel extruded through said gap, wherein an annular fixed member which forms said fixed portion is fixed securely at a given position in the inside of said body, and wherein a small-diameter portion is formed on a distal end side of said movable core, and said squeezing portion is formed on an inner peripheral portion of said annular fixed member for guiding an outer peripheral portion of said small-diameter portion.

9. A fuel injection valve comprising:

a) a body;

b) an electromagnetic solenoid disposed in the inside of said body;

c) a movable core movable in an axial direction and disposed in an inside of said electromagnetic solenoid;

d) a needle valve fixedly secured to a distal end of said movable core, said needle valve disposed in the inside of said body such that said needle valve is movable in the axial direction;

e) a fixed portion disposed at a given position in the inside of said body such that said movable core approaches said fixed portion at a time said needle valve in the valve is moved in a closing direction, and such that a gap is formed between said fixed portion and said movable core at the time when said valve is being closed; and f) squeezing means being operable such that when fuel which remains in the gap formed between said movable core and said fixed portion is pressurized in correspondence with the movement of said movable core toward the valve closing side, said flow of fuel is squeezed at a portion which defines a passage for the fuel extruded through said gap, wherein a plate-like space or a wedge-like space is partially and additionally formed in a space formed between said movable core and said fixed portion so as to adjust the squeezing reaction force generated on said movable core at the time when said the valve is being closed.

* * * * *